US009411281B2

(12) United States Patent
Kondoh et al.

(10) Patent No.: US 9,411,281 B2
(45) Date of Patent: Aug. 9, 2016

(54) FIXING MEMBER, FIXING DEVICE, AND IMAGE FORMING APPARATUS

(71) Applicants: Tsuneaki Kondoh, Kanagawa (JP); Junichiro Natori, Kanagawa (JP); Tomoaki Sugawara, Kanagawa (JP)

(72) Inventors: Tsuneaki Kondoh, Kanagawa (JP); Junichiro Natori, Kanagawa (JP); Tomoaki Sugawara, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/429,896

(22) PCT Filed: Oct. 11, 2013

(86) PCT No.: PCT/JP2013/078398
§ 371 (c)(1),
(2) Date: Mar. 20, 2015

(87) PCT Pub. No.: WO2014/065219
PCT Pub. Date: May 1, 2014

(65) Prior Publication Data

US 2015/0248083 A1 Sep. 3, 2015

(30) Foreign Application Priority Data

Oct. 26, 2012 (JP) ..... 2012-236551
Aug. 2, 2013 (JP) ..... 2013-161002

(51) Int. Cl.
*G03G 15/20* (2006.01)

(52) U.S. Cl.
CPC ..... *G03G 15/206* (2013.01); *G03G 15/2057* (2013.01)

(58) Field of Classification Search
USPC ..... 399/107, 110, 122, 320, 328–333; 492/49, 53, 56, 57, 59; 428/36.8, 334
See application file for complete search history.

(56) References Cited

U.S. PATENT DOCUMENTS 5,547,759 A * 8/1996 Chen ..... B32B 25/14 219/244
6,680,095 B2 * 1/2004 Gervasi ..... B32B 15/08 428/334
6,696,158 B1 * 2/2004 Chen ..... C08K 5/544 399/333
7,558,520 B2 7/2009 Sugawara et al.
7,813,689 B2 10/2010 Nakamura et al.
8,301,068 B2 10/2012 Kondoh et al.
8,452,221 B2 5/2013 Kaneko et al.

(Continued)

FOREIGN PATENT DOCUMENTS

JP 09-204113 8/1997
JP 2000-019879 1/2000

(Continued)

OTHER PUBLICATIONS

International Search Report Issued Nov. 19, 2013 for counterpart International Patent Application No. PCT/JP2013/078398 dated Oct. 11, 2013.

(Continued)

*Primary Examiner* — Hoan Tran
(74) *Attorney, Agent, or Firm* — Cooper & Dunham LLP

(57) ABSTRACT

A fixing member, including a releasing layer, wherein the releasing layer contains a fluoropolymer and a polysiloxane having a cross-linked structure, and wherein the fixing member is used in a process for heating a toner image on a recording medium to thereby fix the toner image onto the recording medium.

10 Claims, 2 Drawing Sheets

(56) References Cited

U.S. PATENT DOCUMENTS

| | | | | |
|---|---|---|---|---|
| 8,463,171 | B2 | 6/2013 | Katano et al. | |
| 2004/0069404 | A1 | 4/2004 | Kondoh | |
| 2004/0224165 | A1 | 11/2004 | Kondoh et al. | |
| 2005/0095381 | A1 | 5/2005 | Kondoh | |
| 2005/0207806 | A1 | 9/2005 | Yoshii et al. | |
| 2006/0008304 | A1 | 1/2006 | Kitano | |
| 2006/0198666 | A1 | 9/2006 | Kondoh et al. | |
| 2007/0025741 | A1 * | 2/2007 | Kitano ..... | G03G 15/2057 399/1 |
| 2007/0065192 | A1 | 3/2007 | Daishi et al. | |
| 2007/0140758 | A1 | 6/2007 | Aze et al. | |
| 2009/0003903 | A1 | 1/2009 | Katano et al. | |
| 2009/0022527 | A1 | 1/2009 | Nakamura et al. | |
| 2009/0324309 | A1 | 12/2009 | Nakamura et al. | |
| 2010/0226701 | A1 | 9/2010 | Moorlag | |
| 2011/0013957 | A1 | 1/2011 | Katano et al. | |
| 2011/0217098 | A1 | 9/2011 | Tomono et al. | |
| 2011/0268480 | A1 | 11/2011 | Katano et al. | |
| 2012/0322967 | A1 | 12/2012 | Kondoh et al. | |
| 2013/0322942 | A1 | 12/2013 | Kondoh et al. | |

FOREIGN PATENT DOCUMENTS

| | | |
|---|---|---|
| JP | 2004-256721 | 9/2004 |
| JP | 2005-144751 | 6/2005 |
| JP | 2006-048028 | 2/2006 |
| JP | 2007-058197 | 3/2007 |
| JP | 2007-086228 | 4/2007 |
| JP | 2008-115343 | 5/2008 |
| JP | 2012-181381 | 9/2012 |
| KR | 10-2012-0099510 | 9/2012 |

OTHER PUBLICATIONS

European search report dated Oct. 23, 2015 in corresponding. European Patent Application No. 13848223.7.
Korean official action dated May 30, 2016 (and English translation) in corresponding Korean patent application No. 10-2015-7013643.

* cited by examiner

FIXING MEMBER, FIXING DEVICE, AND IMAGE FORMING APPARATUS

TECHNICAL FIELD

The present invention relates to a fixing device to be provided in an electrophotographic image forming apparatus such as a copier, a printer, and a facsimile; and a high durable fixing member to be provided in the fixing device.

BACKGROUND ART

Conventionally, a device employing an electrophotographic system, for example an image forming apparatus such as a copier, a printer, and a facsimile, typically includes a rotatable photoconductor drum. In the device, a photoconductive layer of the photoconductor drum is uniformly charged, followed by being exposed to laser beams emitted from a laser scanning unit, to thereby form a latent electrostatic image on the photoconductor drum. The latent electrostatic image is developed with a toner, and then is transferred onto a transfer sheet serving as a recording material. The resulting transfer sheet is passed through a heat fixing device, to thereby thermally fix the image thereon. The device is equipped with a system for performing the aforementioned operations. As for a fixing system, generally, there has been employed a system, in which a toner deposited on a recording sheet is thermally softened and simultaneously pressed by passing the recording sheet between a fixing member for heating the toner (fixing roller or fixing belt) and a press roller that is in contact with the fixing member with pressure. In this fixing system, the toner image fused on the sheet is brought into contact with the fixing member, therefore, a material having excellent releasability (e.g., fluororesin) is formed into a layer with a thickness of 5 μm to 30 μm on the fixing member.

However, the fixing member used in the fixing system is locally abraded on regions of a fixing surface corresponding to edge portions (edge sides) of printing paper because numerous sheets of printing paper having the same width are conveyed on the same position relative to the fixing member. Accordingly, in the case of using printing paper having a wide width beyond the abraded portion, image quality is deteriorated, which is problematic. That is, when the fixing member is partially abraded, the abraded portion is not appropriately heated or pressured. Therefore, fixing failure may occur in the abraded portion or image failure may occur by transferring a shape of the abraded portion onto an image.

Recently, an elastic layer which has satisfactory elasticity is needed to be formed as an intermediate layer for the purpose of achieving fixability suitable for a color image, which is problematic in causing abrasion resistance to be significantly lowered.

In order to solve the above problem, as a means for improving abrasion resistance of the releasing layer, it has been known that filler such as inorganic filler is added to a fluorine-containing material which constitutes the releasing layer (see, for example, PTL 1). However, in this method, a molten toner is deposited on the inorganic filler portion to thereby significantly deteriorate releasability. In addition, the releasing layer is greatly increased in hardness, which deteriorates image quality. These problems are especially significant in a color image. In the case of the inorganic filler, the effect of improving abrasion resistance is deteriorated over time due to exfoliation of the filler. Further, the exfoliated filler may act as abrasive to promote abrasion.

CITATION LIST

Patent Literature

[PTL 1] Japanese Patent Application Laid-Open (JP-A) No. 2000-019879

SUMMARY OF INVENTION

Technical Problem

The present invention aims to solve the aforementioned various problems in the art, and to achieve the following object. An object of the present invention is to provide a fixing member which is improved in uneven abrasion of edges of printing paper while maintaining durability and releasability of a releasing layer.

Solution to Problem

Means for solving the above problems are as follows.

That is, a fixing member of the present invention includes:

a releasing layer, wherein the releasing layer contains a fluoropolymer and a polysiloxane having a cross-linked structure, and wherein the fixing member is used in a process for heating a toner image on a recording medium to thereby fix the toner image onto the recording medium.

Advantageous Effects of Invention

The present invention can solve the aforementioned various problems in the art, and exerts an extremely excellent effect of providing a fixing member which can reduce uneven abrasion of edges of printing paper serving as a recording medium and has improved durability.

DESCRIPTION OF EMBODIMENTS

The present invention now will be explained in detail.

First, one example of an image forming apparatus in which a fixing member of the present invention is used will be outlined.

Figure 1A:
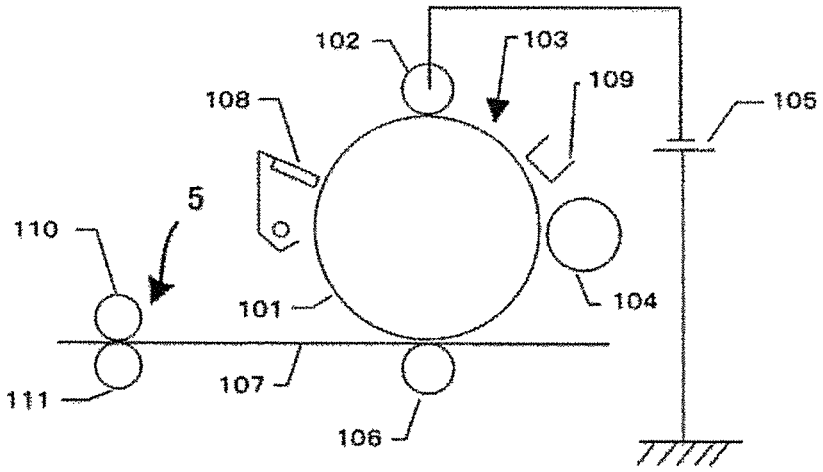
FIG. 1A is a schematic view illustrating one example of an image forming apparatus of the present invention.
Figure 1B:
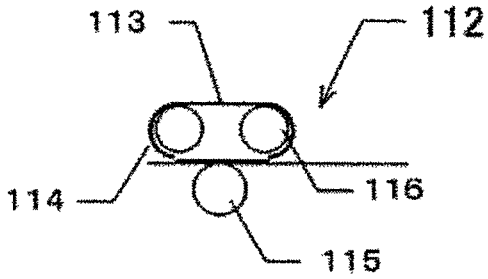
FIG. 1B is a schematic view illustrating one example of a belt-type fixing device of the present invention.

FIGS. 1A and 1B conceptually illustrates a configuration of a photoconductor, an image forming system, and a fixing device in a copier.

An image forming process in this electrophotographic image forming apparatus includes: uniformly charging a photoconductive layer of a rotating photoconductor drum 101 using a charging roller 102; exposing the photoconductive layer to laser beams 103 emitted from a laser scanning unit (not illustrated) to thereby form a latent electrostatic image on the photoconductor drum 101; developing the latent electrostatic image with a toner to form a toner image; transferring the toner image onto a recording sheet 107; and passing the recording sheet 107 through a fixing device 5 to heat and press the toner image to thereby fix the toner image onto the recording sheet.

Note that, in the figure, reference numerals 104, 105, 106, 108, and 109 denote a developing roller, a power pack (power source), a transfer roller, a cleaning device, and a surface potentiometer, respectively.

A heating roller 110 which consists of a base and an elastic layer provided on the base is used in the fixing device 5. The heating roller 110 includes a heater (e.g. a halogen lamp) is provided in a hollow part of a core metal along the rotation centerline thereof, and the heating roller 110 is heated from inside by radiant heat of the heater.

Moreover, a pressure roller 111 is provided opposed to and in parallel with the heating roller 110 so as to be in contact with the heating roller with pressure. By passing the recording sheet between the pressure roller 111 and the heating roller 110, the toner deposited on the recording sheet is softened by heat from the heating roller 110, and at the same time, is pressed by being sandwiched between the pressure roller 111 and the heating roller 110, to thereby fix the toner image onto the recording sheet. The fixing device of the present invention is used in at least one of the heating roller 110 and the pressure roller 111.

In the present invention, as illustrated in FIG. 1B, the fixing device 5 may be a belt-type fixing device.

In this figure, reference numerals 113, 114, 115, and 116 denote a fixing belt, a fixing roller, a pressure roller, and a heating roller, respectively. Here, four color toners, i.e., magenta, cyan, yellow, and black, are used in a full-color copier or a laser printer. When fixing a color image, these color toners should be mixed in a molten state. Accordingly, it is needed that the toner is designed to have a low melting point so as to be easily melted, and that a plurality of the color toners are uniformly mixed in the molten state on a surface of the fixing belt 113 in the manner that the color toners are covered with the fixing belt (the fixing roller and the fixing belt may be collectively referred as a "fixing member" hereinafter.) The fixing belt serving as a heat generating member is suspended around and supported by the fixing roller 114 and the heating roller 116.

Figure 2:
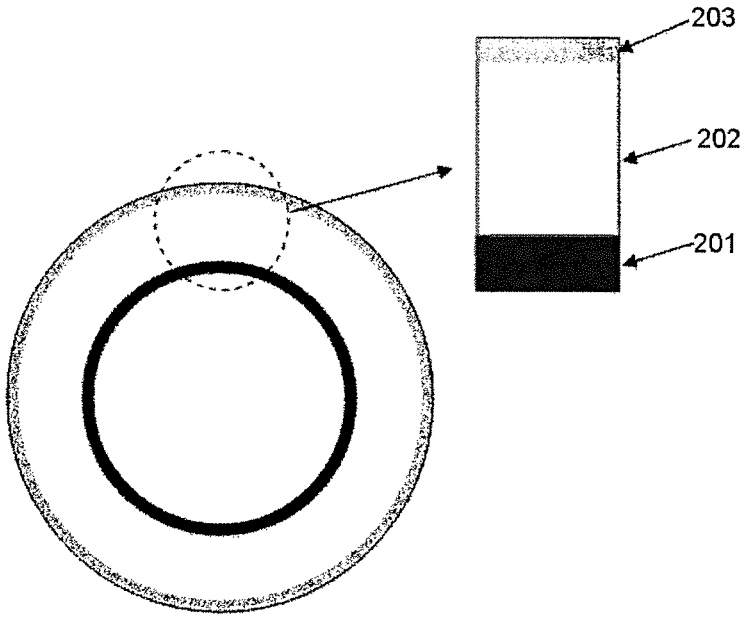
FIG. 2 is a schematic view illustrating one example of a configuration of a fixing member of the present invention.

FIG. 2 is a schematic view illustrating one example of a configuration of a fixing member. The fixing member includes a base 201, an elastic layer 202, and a releasing layer 203.

<Base>

The base 201 is formed of a heat-resistant material. For example, resin materials such as polyimide, polyamide imide, polyether ether ketone (PEEK), polyether sulfone (PES), polyphenylene sulfide (PPS), and a fluororesin can be used. Also, a resin material in which magnetic electroconductive particles are dispersed can be used. In this case, the magnetic electroconductive particles are added to the resin material in a percentage of 20% by mass to 90% by mass. Specifically, the magnetic electroconductive particles are dispersed in the resin material in a varnish state by means of a dispersing device, such as a roll mill, a sand mill, or a centrifugal deaerator.

The resultant is adjusted with a solvent to an appropriate viscosity, and then molded in a mold so as to have a desired layer thickness. Thus, the base is formed.

The base may also be formed of metal. Specific examples of the metal include nickel, iron, chromium, and alloys thereof. The metal may generate heat by itself. The thickness of the base is preferably 30 μm to 500 μm from the viewpoints of thermal capacity and strength.

In the case where the base is formed of metal, taking into account bending thereof, the base desirably has a thickness of 100 μm or less. In the case where the base is formed of metal, a desired Curie point can be attained by adjusting an amount of each material to be added and processing conditions. By forming a heat generating layer using the magnetic electrical conductive material having the Curie point at the temperature around the fixing temperature of the fixing belt, the heat generating layer can be heated by electromagnetic induction without being overheated.

The base may also be formed of an elastic material. Examples of the elastic material include natural rubber, SBR, butyl rubber, chloroprene rubber, nitrile rubber, acrylic rubber, urethane rubber, silicone rubber, fluorosilicone rubber, fluororubber, and liquid fluoroelastomer. Of these, silicone rubber, fluorosilicone rubber, fluororubber, fluorocarbon siloxane rubber, and liquid fluoroelastomer are preferable from the viewpoint of heat resistance.

<Elastic Layer>

The elastic layer 202 formed on the base is made of a heat-resistant elastic material, for example, an elastic rubber, preferably a heat-resistant rubber. Examples of the elastic rubber include natural rubber, SBR, butyl rubber, chloroprene rubber, nitrile rubber, acrylic rubber, urethane rubber, silicone rubber, fluorosilicone rubber, fluororubber, and liquid fluoroelastomer. Of these, silicone rubber, fluorosilicone rubber, fluororubber, fluorocarbon siloxane rubber, and liquid fluoroelastomer are preferable from the viewpoint of heat resistance. Further, silicone rubber and fluorosilicone rubber are more preferable from the viewpoints of heat resistance and wettability of a releasing agent.

A method for forming the elastic layer is not particularly limited and may be appropriately selected depending on the intended purpose. Examples thereof include a blade coating method, a roll coating method, and a die coating method.

The thickness of the elastic layer is not particularly limited and may be appropriately selected depending on the intended purpose, but is preferably 100 μm to 250 μm.

<Releasing Layer>

The releasing layer contains a fluoropolymer and a polysiloxane having a cross-linked structure.

The fluoropolymer may be or may not be chemically bound to the polysiloxane. However, the fluoropolymer is preferably chemically bound to the polysiloxane.

Example of a method for chemically binding the fluoropolymer to the polysiloxane includes a surface modifying treatment described below.

Alternatively, the fluoropolymer may be chemically bound to the polysiloxane by allowing a polysiloxane to chemically react with a fluoropolymer having a fluorinated polyether backbone and a terminal reactive group capable of being cross-linked with silicone. This method allows a cross-linking point of a cross-linked structure to be formed on the fluoropolymer. Example of the chemical reaction includes formation of a siloxane bond through condensation of silanol groups.

For the releasing layer 203 formed on the base or on the elastic layer, for example, fluoropolymer such as polytetrafluoroethylene (PTFE), tetrafluoroethylene-perfluoroalkylvinyl ether copolymer (PFA), and tetrafluoroethylene-hexafluoropropylene copolymer (FEP) can be used. Similarly, a mixture of the above polymers, a dispersion of the above polymers in a heat-resistant resin or rubber, or a fluoroelastomer containing fluorinated polyether in a reactive group capable of being cross-linked with silicone thereof can also be used. Of these, particularly preferred are those containing a fluoropolymer from the viewpoint of achieving both of strength and smoothness.

A material having low specific heat and low thermal conductivity such as hollow filler and an electroconductive material can be incorporated into the releasing layer.

A method for forming the releasing layer is not particularly limited and may be appropriately selected depending on the intended purpose. Examples thereof include a method in which an elastic layer is covered with a tube-like material, a wet spray coating method, and a method in which powder material is applied onto an elastic layer, followed by baking.

The release layer preferably has an average thickness of 0.01 μm to 5 μm, more preferably 0.01 μm to 3 μm. When the average thickness is less than 0.01 μm, sufficient layer formability may not be ensured due to unevenness on the elastic layer. When the average thickness is greater than 5 μm, level differences may be created on an image, and thus image failure may occur due to differences in glossiness.

As the fluoropolymer used in the present invention, there can be used polytetrafluoroethylene (PTFE) having heat resistance for continuous use at 260° C., which is the highest among coatings, and having excellent non-adhesive property and low frictionality. Similarly, tetrafluoroethylene-hexafluoropropylene copolymer (FEP) may be used which has excellent chemical resistance, corrosion resistance, and non-adhesive property, and which results in a smooth coating with less pinhole. Additionally, tetrafluoroethylene-perfluoroalkylvinyl ether copolymer (PFA) can also be used which has electrical property and chemical resistance equivalent to FEP, is improved in mechanical property, and can be easily processed. Still other examples of the fluoropolymer include fluororesins such as polychlorotrifluoroethylene (PCTFE), polyvinylidene fluoride (PVDF), polyvinyl fluoride (PVF), ethylene/tetrafluoroethylene copolymer (ETFE), and ethylene/chlorotrifluoroethylene (ECTFE); VDEF (vinylidene fluoride)-based fluororubbers; VDF-HFP (vinylidene fluoride/hexafluoropropylene)-based fluororubbers; propylene/tetrafluoroethylene-based fluororubbers; tetrafluoroethylene/perfluoroalkylvinyl ether-based fluororubbers; and thermoplastic fluororubbers (e.g., fluorosilicone rubbers, fluorophosphazene rubbers, and fluorine-containing triazine elastomers).

Examples of a commercial product of the fluoropolymer include TEFLON (registered trademark) PTFE, TEFLON (registered trademark) FEP, TEFLON (registered trademark) PEA, and TEFLON (registered trademark) paint AF1600, and AF2400 series (all products are of Du Pont-Mitsui Fluorochemicals Company, Ltd.), TEDLAR series (product of Du Pont-Mitsui Fluorochemicals Company, Ltd.; PVF), TEFZEL series (product of E.I. du Pont de Nemours & Company Inc.; ETFE), KALREZ series (product of E.I. du Pont de Nemours & Company Inc.; FFKM) rubber, PCTFE paint (product of TOHO KASEI Co., Ltd.), NOVAC (product of Sumitomo 3M Limited), FLUORINERT (product of Sumitomo 3M Limited), DAIFLON (product of DAIKIN INDUSTRIES, LTD; PEA), DAIFLON ETFE (product of DAIKIN INDUSTRIES, LTD), DAIFLON EFEP (product of DAIKIN INDUSTRIES, LTD), DAI-EL G-700 (product of DAIKIN INDUSTRIES, LTD), ZEFFLE (product of DAIKIN INDUSTRIES, LTD), FLURON series (product of ASAHI GLASS CO., LTD.; PTFE/PFA/ETFE), LUMIFLON (product of ASAHI GLASS CO., LTD.; fluororesin for paint), AFLON (product of ASAHI GLASS CO., LTD.; ETFE), POLYFLON (product of DAIKIN INDUSTRIES, LTD; PTFE), FLUON (product of DAIKIN INDUSTRIES, LTD; PTFE), NEOFLON (product of DAIKIN INDUSTRIES, LTD; FEP, PFA, ETFE), DAIFLON (product of DAIKIN INDUSTRIES, LTD; PCTFE, PVDF), HALAR series (Product of Solvay Solexis, Inc.; ECTFE), HYLAR series (Product of Solvay Solexis, Inc.; PVDF), KYNAR series (product of Arkema, Inc.; PVDF), TECNOFLON series (Product of Solvay Solexis, Inc.; FFKM), FLUONATE (product of DIC Corporation; solvent-soluble fluororesin), CEFRAL SOFT (product of Central Glass Co., Ltd.), CEFRAL COAT (product of Central Glass Co., Ltd.; paint), ALESFLON series (product of Kansai Paint Co., Ltd.; paint), CHUKOHFLO (product of Chukoh Chemical Industries, Ltd.), NAFLON (product of NICHIAS Corporation), NITOFLON (product of NITTO DENKO CORPORATION), VALFLON (product of NIPPON VALQUA INDUSTRIES, LTD.), SUNFLON (product of MITSUBISHI CABLE INDUSTRIES, LTD), YODOFLON (product of Yodogawa Hu-Tech Co., Ltd.), PILLAFLON (product of NIPPON PILLAR PACKING CO., LTD.), JUNFLON (product of Junkosha Inc.), RAREFLON (product of NOK CORPORATION), and ESFLON (product of SAKAGAMI SEISAKUSHO LTD.).

Other examples of a commercial product of the fluoropolymer include conventionally known fluorine-containing synthetic rubbers such as FLUORO RUBBER 1F4 (product of 3M Company; poly FBA, 1,1-dihydroperfluoro butyl acrylate polymer), FLUORO RUBBER 2F4 (product of 3M Company; 3-trifluoromethoxy-1,1-dihydro-fluoro-propyl acrylate polymer), KEL-F Elastomer (product of 3M Company; ethylene chloride trifluoride-vinylidene fluoride copolymer; production has already finished in 1956), VITON A (product of E.I. du Pont de Nemours & Company Inc.; vinylidene fluoride-perfluoropropene copolymer), FLUOREL KEL-F 214 (product of 3M Company; vinylidene fluoride-perfluoropropene copolymer), SILASTIC LS-53 (product of Dow Corning Corporation; polymer containing fluoroalkyl-silane as a main component), FLUORO POLYESTER (product of Hooker Electrochemical Company; polyester of adipoylchloride and hexafluoro pentanediol), DAI-EL G-801 (product of DAIKIN INDUSTRIES, LTD), SILASTIC LS-63U (product of Dow Corning Toray Co., Ltd.; fluorosilicone rubber), TECHNOFLON series (FFKM; Product of Solvay Solexis, Inc.), VITON series (product of E.I. du Pont de Nemours & Company Inc.; FPM/FKM-based fluororubbers), KUREHA KF polymer (product of KUREHA CORPORATION; PVDF).

The above materials or elastomer materials contained in the above-listed products should have, after being cross-linked, all of hardness which is sufficient to allow molten-toner to be pressure-plastically fluidized, elasticity which is sufficient not to impair a toner image, ability to be restored to their original shape, and toughness which ensures high durability.

In the present invention, the releasing layer preferably contains a resistance regulating agent. Preferable example of the resistance regulating agent includes an electroconductivity imparting agent. As for the electroconductivity imparting agent, powdery materials may be used such as metals and metallic (sub)oxides (e.g., copper, silver, zinc, tin, antimony, germanium, aluminium, indium doped tin oxide (ITO), tin oxide, titanium oxide, and zinc oxide). Examples of the resistance regulating agent include electroconductive carbons such as KETJEN BLACK EC and acetylene black; carbons for rubber such as SAF, ISAF, HAF, FEF, GPF, SRF, FT, and MT; carbon for coloring which has been subjected to oxidation treatment; pyrolytic carbon; and electroconductive polymers such as polyaniline, polypyrrole, and polyacetylene.

As for the resistance regulating agent, ionic electroconductive materials may be used such as inorganic ionic electroconductive agents such as sodium perchlorate, lithium perchlorate, calcium perchlorate and lithium chloride; and organic ionic electroconductive agents such as modified fatty acid dimethylammonium ethosulfate, stearic acid ammonium acetate, lauric acid ammonium acetate and octadecyl trimethylammonium perchlorate.

In one embodiment of the present invention, the releasing layer is subjected to a surface modifying treatment.

The surface modifying treatment is divided into a "surface activating treatment" and a "cross-linking treatment with a surface modifying agent".

The "surface modifying treatment" can provide a cross-linking point of a siloxane structure on the fluoropolymer. Examples of the "surface activating treatment" include a plasma treatment, an electron beam cross-linking treatment, and a UV ozone treatment. In the case of the plasma treatment, a parallel plate-type device, capacitive coupling-type device, and inductive coupling-type device can be used as a plasma generator. Moreover, the plasma treatment can be performed by corona discharge, or by means of an atmospheric pressure plasma device. The plasma treatment is preferably a low pressure plasma treatment from the viewpoint of durability. The reaction pressure for the plasma treatment is 0.05 Pa to 100 Pa, preferably 1 Pa to 20 Pa. As reaction gas, for example, inert gas, rare gas, or oxygen is effectively used. Of these, argon is preferable from the viewpoint of long lasting effect. The irradiated electric energy for the plasma treatment is defined as the product of output and irradiation time, and is 5 Wh to 200 Wh, preferably 10 Wh to 50 Wh.

In the conventional art, it has been proposed to form active groups through excitation and oxidation by a plasma treatment or a UV treatment for the purpose of enhancing adhesion force between layers. However, this method has been known to be effective only when applied to between layers, so that the method is not suitable to be applied to a surface of the releasing layer because it deteriorates releasability of the releasing layer.

In the present invention, it is believed that the plasma treatment promotes recross-linking and binding on the surface to the degree of not inhibiting releasability thereof, and forms active groups which are, in turn, form a cross-linked structure with a coupling agent treatment described below.

The "cross-linking treatment with a surface modifying agent" is performed with, for example, a coupling agent, various monomers, or formation of a photosensitive functional group, a hydrophobic functional group, or a hydrophilic functional group. Conventionally, it has known that fluororesins (e.g., ethylene chloride trifluoride-vinylidene fluoride copolymer) is surface-modified by organic peroxides, polyisocyanates (see, for example, JP-A No. 2008-115343), or polyamines. Also, fluororesins (e.g., FPM/FKM fluororubbers) have conventionally known to be surface-modified by organic peroxides and polyamines.

However, in the present invention, a surface is modified by a cross-linking via a siloxane bond. For example, materials (e.g., coupling agent) which allows a cross-linking reaction at a siloxane moiety having a lower alkyl group (preferably, a methyl group) for ensuring releasability can be used.

Examples of materials to be surface-modified include homopolymer or copolymer which constitutes a fluoropolymer material. For example, the fluoropolymer material contains an amorphous resin containing at least one functional group selected from a hydroxyl group, a silanol group, a carboxyl group, and a hydrolyzable group. The amorphous resin contained in the releasing layer is bound to the heat-resistant rubber contained in the elastic layer via oxygen atoms. The amorphous resin is a resin having perfluoroalkyl polyether in its backbone. Examples of the hydrolyzable group include an alkoxy group (e.g., a methoxy group, and an ethoxy group) and an alkoxy silane group (e.g., a methoxy silane group, and an ethoxy silane group). Metal alkoxide or a metal alkoxide-containing solution is used as the coupling agent. Examples of the metal alkoxide include a silicone alkoxide-based monomer represented by the following General Formula (1), a partially hydrolyzed polycondensate thereof having a polymerization degree of about 2 to about 10, a mixture thereof, and/or a solution containing those described above and an organic solvent.

$$R^1_{(4-n)}M(OR^2)_n \qquad \text{General Formula (1)}$$

where $R^1$ and $R^2$ denote a C1-C10 linear or branched alkyl group, an alkyl polyether chain, or an aryl group and derivatives thereof; and n denotes an integer of 1 to 4.

Specific examples of the compound represented by the General Formula (1) include dimethyl dimethoxy silane, diethyl diethoxy silane, diethyl dimethoxy silane, diethyl diethoxy silane, diphenyl dimethoxy silane, diphenyl diethoxy silane, methyl trimethoxy silane, methyl triethoxy silane, tetramethoxy silane, tetraethoxy silane, and tetrapropoxy silane. From the viewpoint of the durability, tetraethoxy silane is particularly preferable. The $R^1$ may be a fluoroalkyl group; or fluoroalkylacrylate or ether perfluoropolyether to which the fluoroalkyl group is further bonded via an oxygen atom. From the viewpoint of flexibility and durability, a perfluoropolyether group is particularly preferable.

Further examples includes: vinyl silanes such as vinyl tris (β-methoxyethoxy) silane, vinyl triethoxy silane, and vinyl trimethoxy silane; acrylic silanes such as γ-methacryloxypropyl trimethoxy silane; epoxy silanes, such as β-(3,4-epoxycyclohexyl)ethyl trimethoxysilane, γ-glycidoxypropyl trimethoxysilane, and γ-glycidoxypropylmethyl diethoxysilane; and amino silanes such as N-β(aminoethyl)-γ-aminopropyl trimethoxysilane, N-β-(aminoethyl)-γ-aminopropylmethyl dimethoxysilane, γ-aminopropyl triethoxysilane, and N-phenyl-γ-aminopropyl trimethoxysilane. Titanate-based coupling agents or aluminium-based coupling agents may be used in combination with the above-listed compounds.

In addition to Si atom, metal atom such as Ti, Sn, Al, or Zr may be used alone or in combination.

A treatment with a surface treating agent such as the aforementioned coupling agent can be performed as follows. The releasing layer is subjected to the activating treatment (e.g., a plasma treatment, an electron beam crosslinking, or a UV ozone treatment), followed by coating with or impregnating with (e.g., dipping into) the surface treating agent in a liquid state. In the case of cross-linking fluoropolymer, it has been found that undesired modification due to excessive progress of a cross-linking can be relatively easily avoided because the cross-linking tends not to be excessively progress, unlike vulcanization of natural rubber, butylene rubber and chloroprene rubber which have unsaturated bonds.

The surface modifying treatment may be performed on "edge portions of printing paper" or an "entire surface of printing paper". However, the surface modifying treatment is preferably limited within "edge portions of printing paper" (see FIG. 3).

Figure 3:
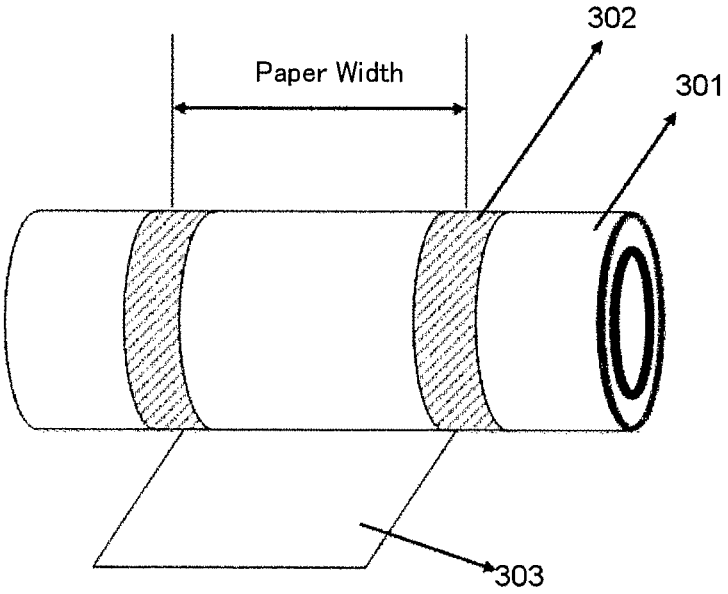
FIG. 3 is a simplified view illustrating on example of a processing portion of an image forming apparatus of the present invention.

Note that, in FIG. 3, reference numerals 301, 302, and 303 denote a belt sample, a surface treated agent, and printing paper, respectively.

By employing a configuration of the present invention, there can be achieved a fixing member which has greatly improved durability against abrasion on edge portions of printing paper by developing satisfactory strength due to hardness in a state in which shearing stress may be applied onto a surface (abrasion load). In addition, a fixing member which can maintain sufficient releasability to obtain a high-quality image can also be achieved. As a result, there can be provided a fixing device and an electrophotographic image forming apparatus which can achieve both of high image quality and high reliability, and can achieve stable fixing over a long period.

As can be seen from the above detail and specific description, the present invention exerts an extremely excellent effect of providing a fixing member which can reduce uneven abrasion of edges of printing paper serving as a recording medium and has improved durability.

Additionally, there can be achieved a flexible fixing member with followability to a color image as well as the above effect, which is resulted from that an elastic layer (e.g., elastic rubber) is provided between the base and the releasing layer, and that the elastic layer is made of an elastic rubber having siloxane bonds in a backbone thereof. By using the fixing member, there can be provided a fixing device which has improved durability and reliability as well as the above effects. Additionally, by using the fixing device, high durable and reliable electrophotographic copier, facsimile, and laser printer can be provided, which exerts an extremely excellent effect of contributing to "reduction in environmental loads" or "improvement in customer satisfaction."

EXAMPLES

The present invention now will be explained with reference to the following Examples, but is not limited thereto.

Example 1

A cylindrical base (polyimide) having a length of 320 mm and thickness of 50 μm was coated with a primer layer for silicone, and was dried. Silicone rubber (DY35-2083, product of Toray Industries, Inc.) was applied thereonto so as to have a thickness of 200 μM, followed by heating at 150° C. for 30 min, and secondarily vulcanizing at 200° C. for 4 hours. Thus, an elastic layer was formed on the base.

Then, a primer for electroconductive fluororesin which contains carbon (product of Du Pont-Mitsui Fluorochemicals Company, Ltd.) was applied onto the elastic layer, and then PFA serving as a releasing layer was applied thereonto so as to have a thickness of 15 μm. The resultant was used as a fixing member. The PFA, which was powdered fluororesin (MP102, product of Du Pont-Mitsui Fluorochemicals Company, Ltd.), was applied by a powder coating, followed by baking at 340° C. for 30 min, removing from a furnace, and standing to cool. The resultant was used as a belt sample.

The belt sample was masked with a PTFE sheet (thickness: 1 mm) so as to expose regions contacting ends of printing paper width (width: ±2 cm from the ends) on a cylindrical surface, and then subjecting to a plasma treatment under the following conditions.

Device: PR-500, product of Yamato Scientific Co., Ltd.
Output: 100 W
Treatment time: 4 min
Reaction gas: argon (99.999%)
Reaction pressure: 10 Pa On the belt sample which has been subjected to the plasma treatment, tetraethoxysilane (tetraethyl orthosilicate) (product of Wako Pure Chemical Industries, Ltd.) was applied by a dip coating at the withdrawal speed of 10 mm/min, followed by leaving to stand under the environment of 60° C. and 90% RH for 30 min or longer, and drying at 150° C. for 10 min. The resultant was used as a fixing member.

The thus produced fixing member was mounted on a copier (IMAGIO MPC 3000, product of Ricoh Company Limited). A paper feeding test was performed using this copier by printing a toner solid image on 30,000 sheets of paper. As for paper, MULTIPAPER SUPER WHITE (product of Askul Co., Ltd.) was used.

Results were evaluated based on criteria described in Table 1.

Example 2

A fixing member was produced and evaluated in the same manner as in Example 1, except that the belt sample was not masked upon the plasma treatment.

Example 3

A fixing member was produced and evaluated in the same manner as in Example 1, except that the reaction gas was changed from argon to oxygen (99.99%).

Example 4

A fixing member was produced and evaluated in the same manner as in Example 1, except that the reaction gas was changed from argon to nitrogen (99.999%).

Example 5

A fixing member was produced and evaluated in the same manner as in Example 1, except that the releasing layer was formed as follows without using PFA. A coating liquid containing 70% by mass of SIFEL 610 (product of Shin-Etsu Chemical Co., Ltd.) and 30% by mass of X-70-580 (product of Shin-Etsu Chemical Co., Ltd.) was applied by a dip coating at the withdrawal speed of 50 mm/min, followed by primarily heating at 120° C. for 30 min and secondarily heating at 200° C. for 4 hours. The resultant was used as the fixing member without subsequent surface activating treatment and tetraethoxysilane treatment.

Comparative Example 1

A cylindrical base (polyimide) having a length of 320 mm and thickness of 50 μm was coated with a primer layer for silicone, and was dried. Silicone rubber (DY35-2083, product of Toray Industries, Inc.) was applied thereonto so as to have a thickness of 200 μm, followed by heating at 150° C. for 30 min, and secondarily vulcanizing at 200° C. for 4 hours. Thus, an elastic layer was formed on the base.

Then, a primer for electroconductive fluororesin which contains carbon (product of Du Pont-Mitsui Fluorochemicals Company, Ltd.) was applied onto the elastic layer, and then PFA serving as a releasing layer was applied thereonto so as to have a thickness of 15 μm. The resultant was used as a fixing member. The PFA, which was powdered fluororesin (MP102, product of Du Pont-Mitsui Fluorochemicals Company, Ltd.), was applied by a powder coating, followed by baking at 340° C. for 30 min, removing from a furnace, and standing to cool. The resultant was used as a belt sample and evaluated in the same manner as in Example 1. The belt sample was not subjected to a cross-linking treatment via a siloxane bond. Accordingly, the releasing layer thereof was also not subjected to the activating treatment, of course.

Evaluation results of Examples and Comparative Examples are shown in Table 2.

TABLE 1

| Evaluation Items and Evaluation criteria | | | |
|---|---|---|---|
| Evaluation Item | Evaluation manner | Acceptable rank | Evaluation criteria |
| Abrasion resistance | Evaluation by ranks of abnormal images due to scratches on a releasing layer of a fixing member caused by frictional abrasion on edge portions of printing paper | 3 or higher | 1: Image fixability was significantly inhibited, and fixing failure was partially observed.<br>2: The resulting image was an abnormal image because there was a difference in glossiness in the image due to the traces of the abrasion<br>3: There was a difference in glossiness in the image due to the traces of the abrasion, but it was acceptable level (i.e., the resulting image was not regarded as an abnormal image)<br>4: No failure |

4-grade evaluation with the highest rating being 4

TABLE 2

| Result list | |
|---|---|
| | Abrasion resistance |
| Example 1 | 4 |
| Example 2 | 4 |
| Example 3 | 3 |
| Example 4 | 3 |
| Example 5 | 3 |
| Comparative Example 1 | 2 |

The following has been found based on the results above.

In Comparative Example 1, abrasion was significantly progressed on the surface of the fixing member, which caused fixing failure. As for releasability, fixing failure did not occur, but differences in glossiness occurred to such extent that the resulting image was regarded as an abnormal image, which was not acceptable.

Meanwhile, in Examples 1 and 2, abrasion resistance at edge portions of printing paper was improved and differences in glossiness did not occur to such extent that the resulting image was regarded as an abnormal image. Accordingly, abrasion resistant effect could be confirmed. Abrasion resistances of the fixing members of Examples 3, 4, and 5 were lower than that of Example 1, but they reached the acceptable level. Accordingly, abrasion resistant effect could be confirmed.

As described above, the present invention can provide a fixing member which has excellent abrasion resistance and does not cause image failures due to abrasion over a long period. As a result, there can be provided a fixing device which has improved durability and reliability. Additionally, by using the fixing device, a high durable and reliable electrophotographic copier, facsimile, and laser printer can be provided, which contributes to "reduction in environmental loads" or "improvement in customer satisfaction."

The fixing member of the present invention can achieve both of high image quality and high reliability, and can achieve stable fixing over a long period, and thus can be suitably used as a fixing member for an electrophotographic copiers, a facsimile, and a laser printer.

Embodiments of the present invention are as follows.

<1> A fixing member, including:

a releasing layer, wherein the releasing layer contains a fluoropolymer and a polysiloxane having a cross-linked structure, and wherein the fixing member is used in a process for heating a toner image on a recording medium to thereby fix the toner image onto the recording medium.

<2> The fixing member according to <1>, wherein the cross-linked structure is formed on a region of the releasing layer which contacts an edge portion of the recording medium.

<3> The fixing member according to <1> or <2>, wherein the fluoropolymer is chemically bound to the polysiloxane.

<4> The fixing member according to any one of <1> to <3>, further including a base and an elastic layer, wherein the elastic layer is provided between the base and the releasing layer.

<5> The fixing member according to <4>, wherein the elastic layer is formed of elastic rubber having siloxane bonds in a backbone thereof.

<6> A fixing device, including:

the fixing member according to any one of <1> to <5>.

<7> The fixing device according to <6>, wherein the fixing member is used as a fixing roller, a pressure roller provided so as to face the fixing roller, or both of the fixing roller and the pressure roller.

<8> The fixing device according to <6>, wherein the fixing member is used as a fixing belt, a pressure belt provided so as to face the fixing belt, or both of the fixing belt and the pressure belt.

<9> An electrophotographic image forming apparatus, including:

the fixing device according to any one of <6> to <8>.

REFERENCE SIGNS LIST

5 fixing device
101 photoconductor drum
102 charging roller
103 exposure
104 developing roller
105 power pack
106 transfer roller
107 recording sheet
108 cleaning device
109 surface potentiometer
110 heat fixing roller
111 pressure roller
112 belt-type fixing device

113 fixing belt
114 fixing roller
115 pressure roller
116 heating roller
201 base
202 elastic layer
203 releasing layer
301 belt sample
302 surface-modified surface
303 printing paper

The invention claimed is:

1. A fixing member, comprising:

a releasing layer, wherein the releasing layer contains a fluoropolymer and a polysiloxane having a cross-linked structure, wherein the fixing member is used in a process for heating a toner image on a recording medium to thereby fix the toner image onto the recording medium, and wherein an average thickness of the releasing layer is 0.01 μm to 5 μm.

2. The fixing member according to claim 1, wherein the cross-linked structure is formed on a region of the releasing layer which contacts an edge portion of the recording medium.

3. The fixing member according to claim 1, wherein the fluoropolymer is chemically bound to the polysiloxane.

4. The fixing member according to claim 1, further comprising a base; and an elastic layer, wherein the elastic layer is provided between the base and the releasing layer.

5. The fixing member according to claim 4, wherein the elastic layer is formed of elastic rubber having siloxane bonds in a backbone thereof.

6. The fixing member according to claim 5, wherein a thickness of the elastic layer is 100 μm to 250 μm.

7. A fixing device, comprising:

the fixing member according to claim 1.

8. The fixing device according to claim 7, wherein the fixing member is used as a fixing roller, a pressure roller provided so as to face the fixing roller, or both of the fixing roller and the pressure roller.

9. The fixing device according to claim 7, wherein the fixing member is used as a fixing belt, a pressure belt provided so as to face the fixing belt, or both of the fixing belt and the pressure belt.

10. An electrophotographic image forming apparatus, comprising:

the fixing device according to claim 7.

* * * * *